US006688868B2

(12) United States Patent
Segers et al.

(10) Patent No.: US 6,688,868 B2
(45) Date of Patent: Feb. 10, 2004

(54) SCREW COMPRESSOR INJECTED WITH WATER

(75) Inventors: Jozef Maria Segers, Lier (BE); Jan Paul Herman Heremans, Antwerpen (BE)

(73) Assignee: Atlas Copco Airpower, naamloze vennootschap (BG)

( * ) Notice: Subject to any disclaimer, the term of this patent is extended or adjusted under 35 U.S.C. 154(b) by 0 days.

(21) Appl. No.: 10/169,095

(22) PCT Filed: Jan. 10, 2001

(86) PCT No.: PCT/BE01/00006

§ 371 (c)(1),
(2), (4) Date: Jul. 11, 2002

(87) PCT Pub. No.: WO01/51813

PCT Pub. Date: Jul. 19, 2001

(65) Prior Publication Data

US 2002/0192096 A1 Dec. 19, 2002

(30) Foreign Application Priority Data

Jan. 11, 2000 (BE) ..... 000015

(51) Int. Cl.[7] ..... F01C 1/16
(52) U.S. Cl. ..... 418/201.1; 418/98
(58) Field of Search ..... 418/98, DIG. 1, 418/201.1

(56) References Cited

U.S. PATENT DOCUMENTS

| | | | | | |
|---|---|---|---|---|---|
| 4,439,121 | A | * | 3/1984 | Shaw | 418/98 |
| RE32,055 | E | * | 12/1985 | Schibbye et al. | 418/98 |
| 5,037,282 | A | * | 8/1991 | Englund | 418/98 |
| 5,727,936 | A | * | 3/1998 | Eriksson et al. | 418/88 |
| 6,302,667 | B1 | * | 10/2001 | Timuska et al. | 418/98 |

* cited by examiner

*Primary Examiner*—Thomas Denion
*Assistant Examiner*—Theresa Trieu
(74) *Attorney, Agent, or Firm*—Bacon & Thomas, PLLC

(57) ABSTRACT

The invention concerns an element of a screw compressor injected with water containing two rotors (2–3) in a rotor chamber (4). The water circuit (11) contains a part (10) in which practically prevails the outlet pressure. On the inlet side, the axle journals (13, 16) are radially supported on hydrodynamic slide bearings (18, 19). In the housing (1) opposite to the crosscut ends of the axle journals (13, 16) are formed chambers (20, 21) which are connected to the above-mentioned part (10) or to the inside of the rotor chamber (4). On the outlet side, the axle journals (14, 17) are radially supported on hydrodynamic slide bearings (25, 26) on the one hand, and they are axially supported on hydrostatic slide bearings (27, 28) on the other hand which are connected to the above-mentioned part (10) of the water circuit (11), or on hydrodynamic slide bearings (37, 38).

11 Claims, 3 Drawing Sheets

SCREW COMPRESSOR INJECTED WITH WATER

BACKGROUND OF THE INVENTION

The present invention concerns an element of a screw compressor injected with water containing two co-operating rotors which are bearing-mounted in a housing, whereby this housing limits a rotor chamber in which the rotors are situated and in which flows out a water circuit for the injection of water, and which is provided with an inlet and an outlet and whereby the rotors are supported by means of axle journals, both on the side of the inlet and on the side of the outlet, on radial hydrodynamic slide bearings lubricated with water, and are supported also axially on the outlet side, and whereby, on the inlet side, opposite to the crosscut ends of the axle journals, is formed at least one chamber.

In such compressor elements which are injected with water, water is used as a lubricant instead of oil, for the rotors as well as their bearings.

Onto this water can be added additives such as an anti-corrosion agent and/or an agent which causes a depression of the freezing point.

This makes it possible to obtain oil-free compressed air in a simple manner and to cool the rotors, so that the compression temperature can be kept under control and the efficiency of the compression is large on the one hand, and to avoid sealing problems which would arise if the bearings were lubricated with oil, since water may not penetrate in such bearings and no oil may leak in the compressed air on the other hand.

These compressor elements contain hydrodynamic slide bearings for the radial positioning and hydrostatic or hydrodynamic slide bearings for the axial positioning of the rotors, as opposed to oil-lubricated compressors, which usually make use of rolling bearings.

The axial slide bearings, onto which water is added, have to absorb the axial force, exerted on the rotors by the compressed gas.

Such a compressor element is described in WO 99/13224. On the inlet side, opposite to each of the crosscut ends of the axle journals is formed a chamber, onto which is connected a discharge pipe which opens into the rotor chamber, not far from the inlet.

The chambers opposite to the crosscut ends of the axle journals collect the aqueous lubricating liquid coming from the radial bearings via restricting elements, and they are under a limited pressure.

Moreover, also on the inlet side, opposite to the axle journals or to rings fixed on these axle journals, are formed spaces, onto which is connected a discharge pipe in the same manner which communicates with the rotor chamber in the vicinity of the inlet.

Consequently, the axial forces on each rotor have to be absorbed almost exclusively by the axial bearing on the outlet side, which axial bearing is a combined hydrodynamic/hydrostatic bearing.

As the diameters of the axial bearings are restricted by the centre distance between the rotors, the magnitude of the reactive force which can be generated in the bearing will be determined by the water pressure in the bearing.

In the case of hydrostatic axial bearings, the feeding pressure, required to absorb the above-mentioned axial force, will be larger than the outlet pressure of the compressor element, and with such bearings, an extra pump is required to increase the feeding pressure of the water for the hydrostatic bearings.

In the case of hydrodynamic axial bearings, the speed must be sufficiently high in order to be able to build up enough hydrodynamic pressure, which makes starting up against the pressure impossible on the one hand, and which strongly restricts the magnitude of velocity and thus the field of action of the compressor.

As in the compressor element according to WO 99/13224 the axial bearings on the outlet side are combined hydrodynamic/hydrostatic bearings, the above-mentioned disadvantages are somewhat reduced, but in practice it appears that a pump is necessary to feed the axial bearings, and the compressor element cannot work under high pressures.

SUMMARY OF THE INVENTION

The invention aims an element of a screw compressor injected with water with water-lubricated bearings which does not have the above-mentioned disadvantages and consequently permits a more efficient bearing, whereby, as a result, no pump is required to feed the hydrostatic bearings on the one hand, and, in the case of hydrodynamic axial bearings, the compressor element has a larger field of action on the other hand.

This aim is reached according to the invention in that, only on the inlet side, the chamber which is formed opposite to the crosscut ends of the axle journals, is directly connected to a source of fluid under a pressure which is equal to at least 70% of the outlet pressure of the compressor element.

Thanks to the pressure in the chamber or chambers opposite to the crosscut ends on the inlet side, an axial pressure is created on the crosscut ends of the axle journals towards the outlet side which counteracts the axial force, exerted by the compressed gas on the rotors.

Preferably, a chamber is formed on the inlet side, opposite to each axle journal, and each chamber is directly connected to a source of a fluid under a pressure which is equal to at least 70% of the outlet pressure of the compressor element.

The chamber opposite to the crosscut ends of the axle journals on the inlet side can be connected to the part of the water circuit in which practically prevails the outlet pressure of the compressor element, so that the fluid is the injection water for the rotors.

According to another embodiment of the invention, the above-mentioned chamber is connected to the inside of the rotor chamber.

In this case, not only water but a mixture of gas and water is provided to the chamber. This chamber is preferably connected to the rotor chamber by means of a conduit which is connected to the wall of the rotor chamber in such a place that a mixture of gas and water will flow via the conduit, which still contains relatively much water.

The axial bearing of the axle journals on the outlet side can be formed by hydrodynamic slide bearings which are also connected to the part of the water circuit which is practically situated on the outlet pressure, so that also with such slide bearings the water supply is simple.

The axial bearing of the axle journals on the outlet side can also be formed of hydrostatic bearings which each contain a ring surrounding the axle journal and which is connected to a radially protruding collar on the side of the bodies of the rotors, with on either side in the housing a ring-shaped chamber filled with water under pressure which is connected to the part of the water circuit in which the outlet pressure practically prevails.

Preferably, the outlet of the compressor element opens into a water separator, and the part of the water circuit which is practically situated on the outlet pressure is a conduit which is connected to the water collector part of said water separator.

The compressor element can be driven via the outlet side.

BRIEF DESCRIPTION OF THE DRAWINGS

In order to better explain the characteristics of the invention, some preferred embodiments of an element of a screw compressor injected with water according to the invention are described as an example only without being limitative in any way, with reference to the accompanying drawings, in which.

DETAILED DESCRIPTION OF THE INVENTION

Figure 1:
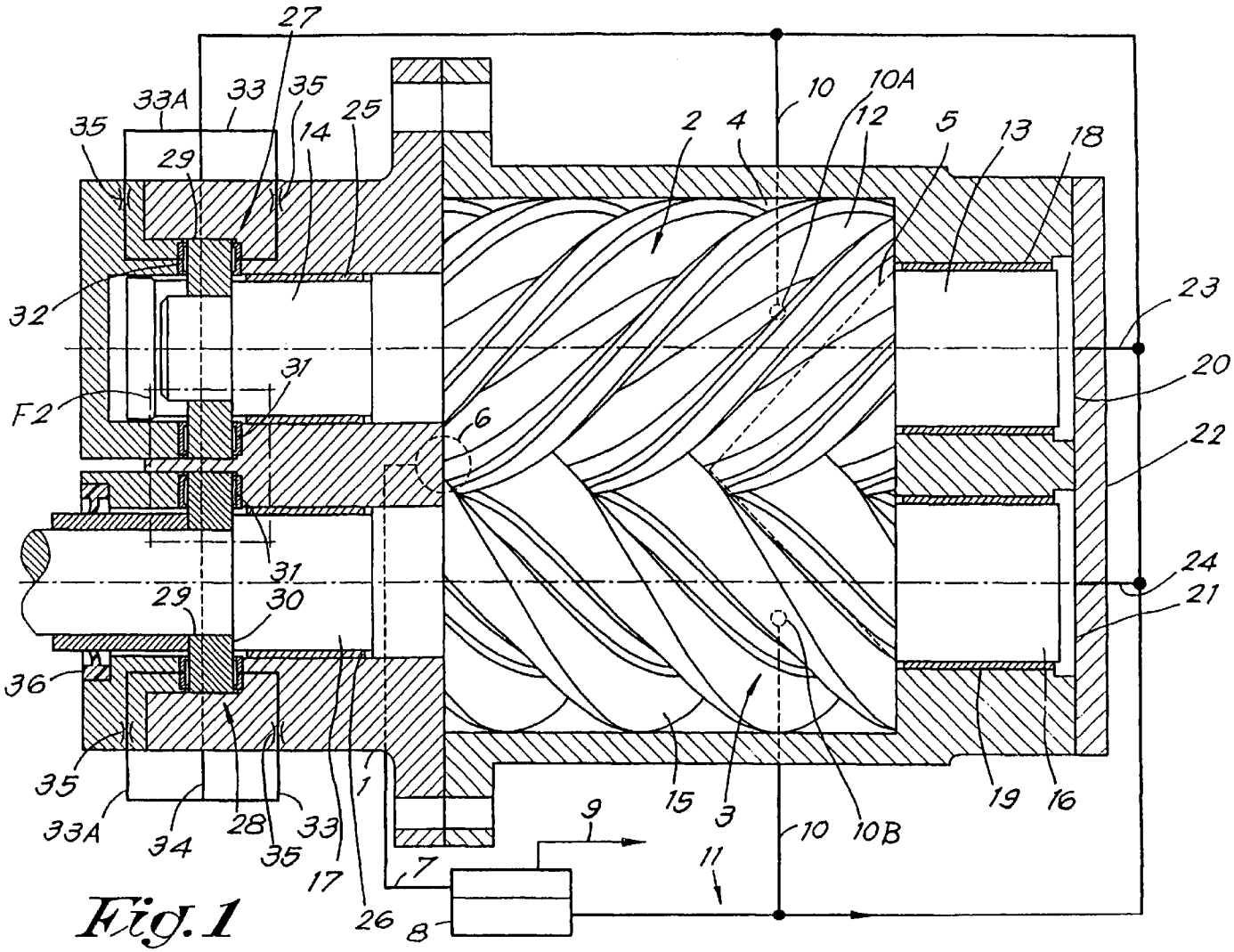
FIG. 1 schematically represents an element of a screw compressor according to the invention.
Figure 2:
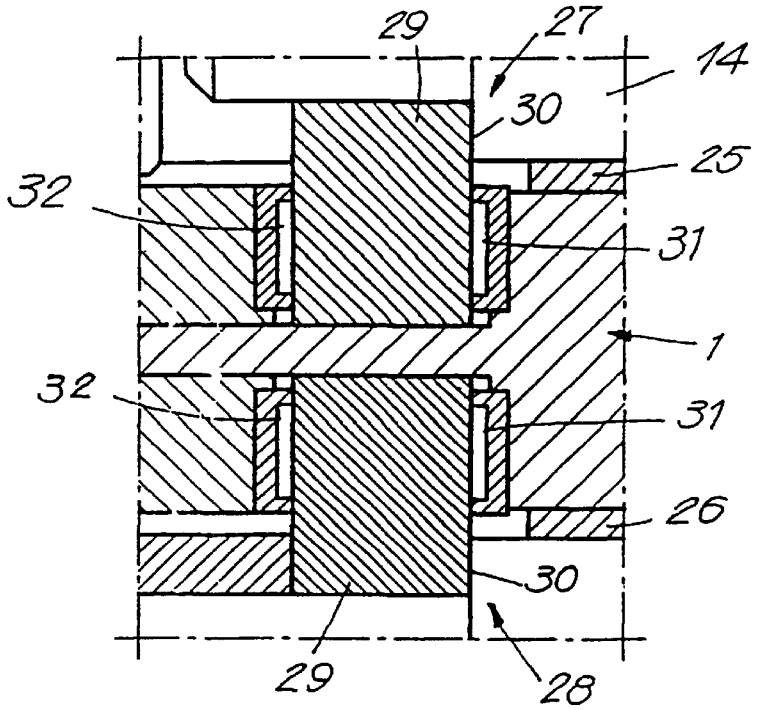
FIG. 2 represents the part which is indicated by F2 in FIG. 1 to a larger scale.

The element of a screw compressor injected with water represented in FIGS. 1 and 2 mainly consists of a housing 1 and two co-operating rotors, namely a female rotor 2 and a male rotor 3 which are bearing-mounted in said housing 1.

As already mentioned, an additive may be added to the water.

The housing 1 encloses a rotor chamber 4 which is provided on one far end, called the inlet side, with an inlet 5 consisting of an inlet opening for the gas to be compressed, and on the other far end, called the outlet side, with an outlet 6 for the compressed gas and the injected water.

On this outlet 6 is connected an outlet conduit 7 which flows out in a water separator 8 into which opens a discharge conduit 9 for compressed gas at the top and onto which is connected a water conduit 10 at the bottom to carry the water back to the rotor chamber 4 into which said water conduit 10 flows out via openings 10*a* and 10*b*.

The water separator 8 and the water conduit 10 are part of a water circuit 11. As the pressure, namely the outlet pressure, in the outlet conduit 7 is relatively high during the normal operation of the element of the screw compressor, practically the same outlet pressure will prevail in the water separator 8, and the water conduit 10 will form a part of the water circuit 11 which is practically situated on the outlet pressure of the element of the screw compressor.

The female rotor 2 contains a screw body 12 and two axle journals 13 and 14, whereas the male rotor 3 also has a screw-shaped body 15 and two axle journals 16 and 17.

On the inlet side, the axle journals 13 and 16 of the rotors 2 and 3 are radially bearing-mounted in the housing 1 by means of hydrodynamic slide bearings 18 and 19 lubricated with water. Where these slide bearings 18 and 19 are situated, the axle journals 13 and 16 are provided with a special coating.

Opposite to the crosscut ends of the axle journals 13 and 16 respectively, closed chambers 20 and 21 are formed in one end part 22 of the housing 1 which are connected directly to the water conduit 10, and thus to the part of the water circuit 11 which is situated on the outlet pressure, via branches 23, 24 respectively, so that a pressure is exerted on the crosscut ends of said axle journals 13 and 16 during the operation of the compressor element.

The leak water leaking out of said chambers 20 and 21 via the axle journals 13 and 16 flows to the rotor chamber 4 and provides the water for the radial slide bearings 18 and 19.

On the outlet side, the axle journals 14 and 17 of the rotors 2 and 3 in the housing 1 are radially supported on a hydrodynamic slide bearing 25, 26 respectively, and axially supported on a hydrostatic slide bearing 27, 28 respectively.

Each of the axial hydrostatic slide bearings 27 and 28 contains a ring 29 which fits up to a collar 30 of the axle journal 14 or 17 on the side of the bodies 12 or 15, and contains a ring-shaped chamber 31, 32 respectively formed in the housing 1 on both radially directed sides of said ring 29.

The two ring-shaped chambers 31 and 32 are connected to a water conduit 34 via a conduit 33, 33A respectively, which is in turn connected to the above-mentioned water conduit 10 and thus to the part on the outlet pressure of the water circuit 11.

In each of the conduits 33 and 33A is provided, as usual with hydrostatic slide bearings, a restriction element 35.

The axle journal 17 is extended outside the housing 1, where it can be coupled to a drive which is not represented in FIG. 1.

The female rotor 2 is not connected to this drive, but is driven by the male rotor 3.

On the outside in relation to the axial slide bearing 28, the axle journal 17 is sealed in relation to the housing 1 by a lip seal 36 in order to stop the leak water from the ring-shaped chamber 32.

The leak water going to the inside provides the water for the radial hydrodynamic slide bearing 26 of the axle journal 17.

In an analogous manner, the leak water of the axial slide bearing 27 provides the water for the radial hydrodynamic slide bearing 25.

As the axle journal 17 protrudes outside the housing 1, no chamber can be formed on a crosscut end of this axle journal 17, of course. Neither opposite to the crosscut end of the axle journal 14 there will be a chamber which is directly connected to the part of the water circuit 11 in which practically prevails the outlet pressure of the compressor element.

When the compressor element is activated, a high pressure on the outlet side, namely the outlet pressure which practically coincides with the pressure in the water separator 8, will exert an axial force on the rotor bodies 12 and 15 in the direction of the inlet side. These forces are largely compensated by the counterpressure on the heads of the axle journals 13 and 16 on the inlet side, since the pressure of the water in the chambers 20 and 21 is equal to the outlet pressure.

This implies that there is little force left for the axial slide bearings 27 and 28 to overcome, and that water under the outlet pressure of the compressor element will suffice to feed said axial hydrostatic slide bearings, so that no extra pump is required.

The pressure drop over the restricting element 35 in the conduit 33 or 33A depends on the flow rate coming through it, which flow rate depends itself on the position of the ring 29. When no axial force is exerted on the bearing, the ring 29 and thus the axle journal 14 or 17 will take up a position of equilibrium whereby the flow rates on either side of the ring 29 are almost equal, and the pressure drops in the two restricting elements 35 in the conduits 33 and 33A of an axle journal 14 or 17 are almost equal.

Each displacement of the axle journal 14 or 17 disturbs said equilibrium and is immediately compensated, as a pressure difference is created in the two ring-shaped chambers 31 and 32 which belong to the axle journal 14 or 17.

Only leak water can flow outside from the axial slide bearings 27 and 28 around the axle journals 14 and 17. Hence, the lip seal 36 around the axle journal 17 is pressureless.

Figure 3:
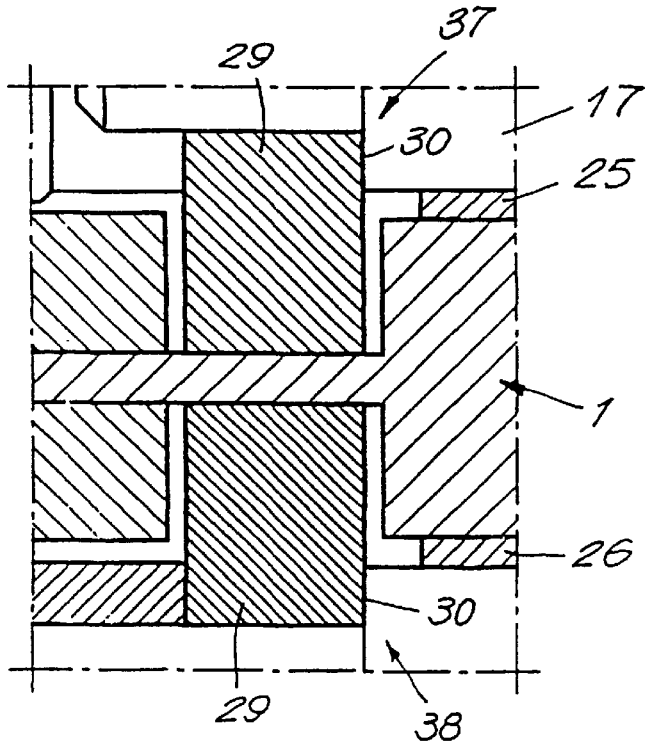
FIG. 3 represents a part analogous to that in FIG. 2, but with reference to another embodiment.

The embodiment represented in FIG. 3 only differs from the above-described embodiment in that the axle journals 14 and 17 are axially supported on the outlet side on a hydrodynamic slide bearing 37, 38 respectively.

Also this hydrodynamic slide bearing 37 or 38 can be of a known construction. As the rotors 2 and 3 are rotated, a water cushion will lift the axle journal 14 or 17. Although the pressure of the water is not very important, it is advantageous from a structural viewpoint to also connect these slide bearings 37 and 38 to the water conduit 10 via conduits 33 and 33A, in which are provided no restricting elements however, via the water conduit 34, so that they can also be fed with water which is practically on the outlet pressure of the element of the screw compressor.

Figure 4:
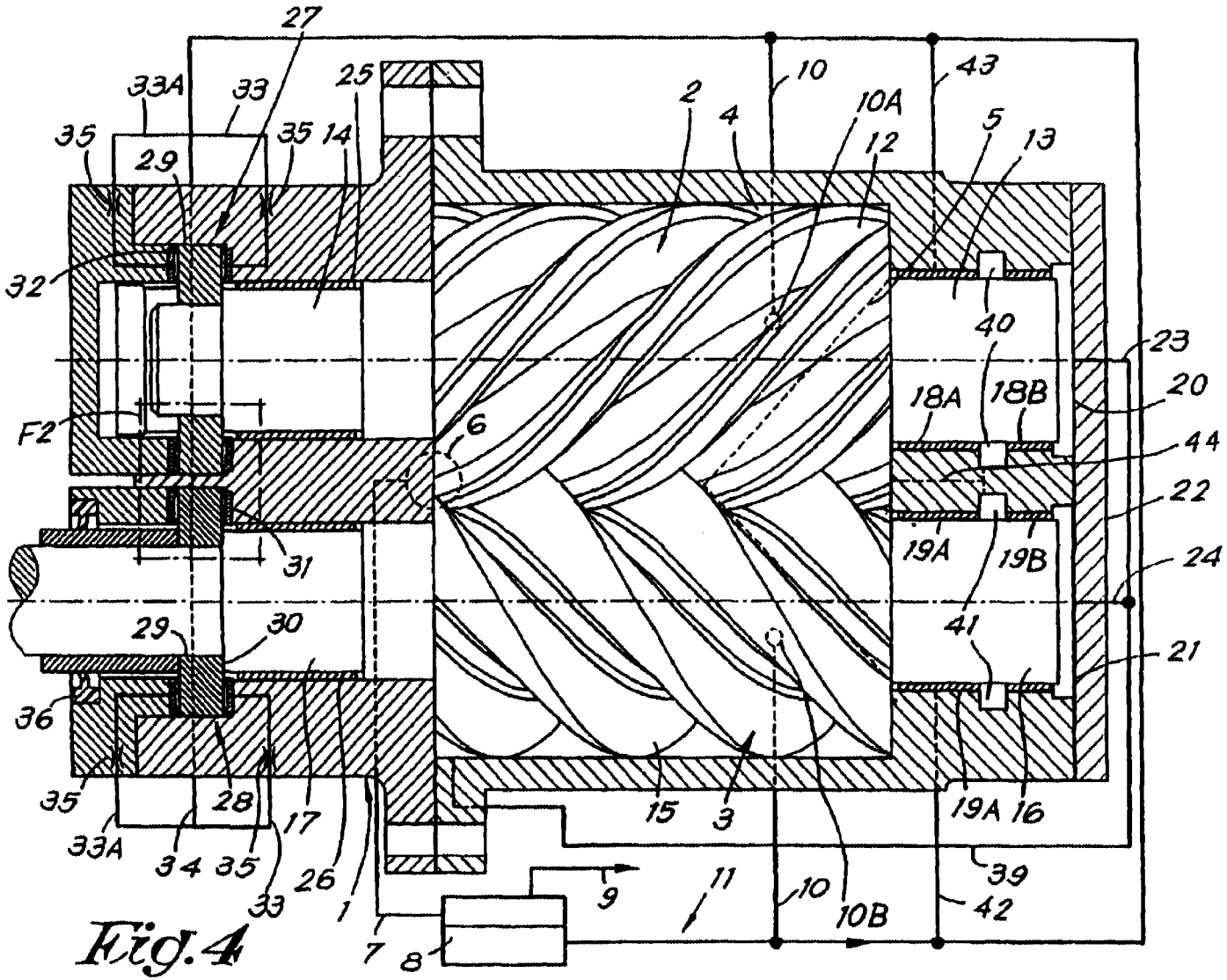
FIG. 4 schematically represents an element of a screw compressor analogous to that in FIG. 1, but with reference to another embodiment of the invention.

The embodiment represented in FIG. 4 mainly differs from the embodiment represented in FIG. 1 in that the two chambers 20 and 21 on the inlet side, opposite to the crosscut ends of the axle journals 13 and 16, are not directly connected to the water collecting part of the water separator 8 via branches 23 and 24, but are directly fed as of the rotor chamber 4 via a separate conduit 39, such that these chambers 20 and 21 are put under a pressure of 70%, and preferably even more, of the outlet pressure of the compressor element.

This conduit is connected to the inside of the rotor chamber 4 via the wall, near the end of the outlet side, so that the mixture of water and compressed air which flows to the chambers 20 and 21 via the conduit 39 is situated at a pressure of more than 70% of the outlet pressure, and preferably as close as possible to said outlet pressure.

Forming branches as of the outlet conduit 7 itself is not advisable, since practically only compressed air and almost no water would be provided to the chambers 20 and 21. By branching off close to the outlet 6, from an axial viewpoint, but on the casing of the rotor chamber 4, in a place where there is relatively much water, one makes sure that the above-mentioned mixture of air and water contains relatively much water, which is good for the lubrication of the axle journals 20 and 21.

Whereas, in the embodiments according to FIGS. 1 to 3, radial hydrodynamic slide bearings 18 and 19 can be fed on the inlet side by means of leak water from the chambers 20 and 21, this manner of feeding the slide bearings 18 and 19 is not indicated when a mixture of air and water is supplied to said chambers 20 and 21, as described above with reference to FIG. 4.

The hydrodynamic pressure can quickly vary, and, as the air in the mixture can be compressed, the pressure variations will result in a compression or expansion of the air, which may damage the bearing surface.

That is why, as represented in FIG. 4, the bearings 18 and 19 are split in two, namely a part 18A, 19A respectively, on the side of the rotor chamber 4, and a part 18B, 19B respectively, on the side of the chambers 20 and 21, with a ring-shaped groove 40 between the parts 18A and 18B which is provided around the axle journal 13 inside the housing 1, and a ring-shaped groove 41 between the parts 19A and 19B which is provided around the axle journal 16 inside the housing.

The parts 18A and 19A form the actual slide bearing and are connected to the part 10 of the water circuit 11, via a conduit 42, 43 respectively, in which practically prevails the outlet pressure, and they are exclusively fed with water under pressure from said part 10.

The parts 18B and 19B of the slide bearings 18 and 19 function as a seal so to prevent that too much air with water flows out of the rotor chamber 4 via the conduit 39, which would imply a loss of efficiency.

The two grooves 40 and 41 are connected to the inlet side of the rotor chamber 4 via a partly common conduit 44, so that air and water which might possibly leak through the parts 18B and 19B is discharged to the inlet side of the rotor chamber 4.

The invention is by no means limited to the above-described embodiment represented in the accompanying drawings; on the contrary, such an element of a screw compressor which is injected with water can be made in all sorts of variants while still remaining within the scope of the invention.

What is claimed is:

1. Element of a screw compressor injected with water containing two co-operating rotors (2–3) which are bearing-mounted in a housing (1), whereby this housing (1) limits a rotor chamber (4) in which the rotors (2–3) are situated and in which flows out a water circuit (11) for the injection of water, and which is provided with an inlet (5) and an outlet (6) and whereby the rotors (2,3) are supported, both on the inlet side and on the outlet side, on radial hydrodynamic slide bearings (18,19,25,26,) lubricated with water by means of axle journals, and are also axially bearing mounted on the outlet side, and whereby, on the inlet side opposite to the crosscut ends of the axle journals (13,16) is formed at least one chamber (20,21), wherein only on the inlet side, the chamber (20,21) which is formed opposite to the crosscut ends of the axle journals (13,16) is directly connected to a source (10,4) of fluid under pressure which is equal to at least 70% of the outlet pressure of the compressor element.

2. Element of a screw compressor according to claim 1, wherein on the inlet side opposite to each axle journal (13,16) is formed a chamber (20, 21), and in that each chamber (20,21) is directly connected to a source (10,4) of a fluid under pressure which is equal to at least 70% of the outlet pressure of the compressor element.

3. Element of a screw compressor according to claim 1, wherein the chamber (20,21) opposite to the crosscut ends of the axle journals (13,16) on the inlet side is connected to the part (10) of the water circuit (11) in which practically prevails the outlet pressure of the compressor element, such that the fluid forms the injection water for the rotors (2–3).

4. Element of a screw compressor according to claim 3, wherein the outlet of the compressor element flows into a water separator (8) and in that the part (10) in which practically prevails the outlet pressure is a conduit which is connected to the water collector part of said water separator (8).

5. Element of a screw compressor according to claim 1, wherein the chamber (20,21) opposite to the crosscut ends of the axle journals (13,16) on the inlet side is connected to the inside of the rotor chamber (4).

6. Element of a screw compressor according to claim 5, wherein the chamber (20,21) is connected to the rotor chamber (4) by means of a conduit (39) which is connected to the wall of the rotor chamber (4) in such a place that a mixture of gas and water will flow through the conduit which still contains relatively much water.

7. Element of a screw compressor according to claim 5, wherein the chamber (20,21) opposite to the crosscut ends of the axle journals (13,16) on the inlet, side is connected to the inside of the rotor chamber (4) at a small distance from the outlet (6), seen in the axial direction of the rotors (2,3).

8. Element of a screw compressor according to claim 5, wherein the hydrodynamic radial bearings (18,19) have two parts (18A,18B; 19A,19B) on the inlet side, whereby the part (18A,19A) on the side of the rotor chamber (4) forms the actual bearing and is connected to a source of water under pressure, preferably a part (10) of the water circuit (11) in which practically prevails the outlet pressure of the compressor element, whereas the other parts (18B,19B) of the above-mentioned bearings (18,19) form a seal and, between the parts (18A and 18B;19A and 19B) of each of the above-mentioned bearings (18,19), is provided a discharge for leaking water and gas.

9. Element of a screw compressor according to claim 1, wherein the axial bearing of the axle journals (14,17) on the outlet side consists of hydrodynamic slide bearings (37,38) which are connected to the part (10) of the water circuit (11) in which practically prevails the outlet pressure.

10. Element of a screw compressor according to claim 1, wherein the axial bearings of the axle journals (14,17) on the outlet side are hydrostatic bearings (27,28) which each contain a ring (29) surrounding the axle journal (14,17) and fitting up to a collar (30) on the side of the bodies (12,15) of the rotors (2,3), with a ring-shaped chamber (31,32) filled with water under pressure on either side of the housing, which is connected to the part (10) of the water circuit (11) in which practically prevails the outlet pressure.

11. Element of a screw compressor according to claim 1, wherein the male rotor (3) is driven via the outlet side.

* * * * *